United States Patent [19]

Barrett

[11] Patent Number: 4,718,289

[45] Date of Patent: Jan. 12, 1988

[54] DRILL CUTTINGS SAMPLE COLLECTOR

[75] Inventor: Wesley F. Barrett, Jakarta Pusat, Indonesia

[73] Assignee: Amoco Corporation, Chicago, Ill.

[21] Appl. No.: 848,889

[22] Filed: Apr. 7, 1986

[51] Int. Cl.[4] ..... E21B 49/00

[52] U.S. Cl. ..... 73/863.57; 73/864.51; 73/153

[58] Field of Search ..... 73/153, 863.41, 863.42, 73/863.44, 863.51, 863.52, 863.53, 863.54, 863.55, 863.56, 863.57, 864.51, 864.63; 175/46, 60

[56] References Cited

U.S. PATENT DOCUMENTS

| | | | |
|---|---|---|---|
| 2,882,014 | 4/1959 | Addison | 73/864.51 |
| 3,110,183 | 11/1963 | Logue | 73/863.53 |
| 3,122,019 | 2/1964 | Wellenius et al. | 73/863.55 |
| 3,135,685 | 6/1964 | Tanner et al. | 73/153 |
| 3,241,371 | 3/1966 | Horeth | 73/863.57 |
| 3,457,789 | 7/1969 | Adler et al. | 73/863.44 |
| 4,091,835 | 5/1978 | Frampton | 73/863.51 |
| 4,548,087 | 10/1985 | Huck | 73/863.57 |

FOREIGN PATENT DOCUMENTS

| | | | |
|---|---|---|---|
| 2425742 | 12/1975 | Fed. Rep. of Germany | 73/863.57 |
| 199503 | 7/1967 | U.S.S.R. | 73/863.52 |

*Primary Examiner*—Stewart J. Levy
*Assistant Examiner*—Robert R. Raevis
*Attorney, Agent, or Firm*—Scott H. Brown; Fred E. Hook

[57] ABSTRACT

An apparatus is disclosed for collecting a sample from a flow of drill cuttings falling from a shale shaker. The apparatus comprises a receptacle having an opening at the upper end thereof for receiving such a sample, a housing for supporting said receptacle, and a cover for covering a selected portion of said opening, the cover being mounted on said housing.

5 Claims, 7 Drawing Figures

DRILL CUTTINGS SAMPLE COLLECTOR

BACKGROUND OF THE INVENTION

1. Field of the Invention

The present invention relates to apparatus for collecting samples of drill cuttings and more particularly to such apparatus which collects such samples from a flow of falling drill cuttings.

2. Setting of the Invention

Exploratory wells are drilled to evaluate penetrated rock formations for producible hydrocarbons. In drilling such wells (and in drilling production wells), circulation fluid is pumped down a string of drill pipe and through a drill bit at the lower end thereof. Such fluid thereafter circulates upwardly in the annulus between the drill pipe and the wellbore and thus flushes drill cuttings, such including drilled rock grains and fragments, from the wellbore.

In the usual operation, the drill cuttings are separated from the circulation fluid at the surface of the wellbore. The circulation fluid is thereafter recirculated through the drill string. Typically, such separation is done by what is referred to in the industry as a shale shaker. The shale shaker comprises one or more vibrating screens. Fluid containing the drill cuttings is poured onto the screen(s) which permit the fluid to pass therethrough for recirculation. The screen(s) vibrate the drill cuttings off one end thereof. The drill cuttings are disposed of by burial on land or put in a barge when drilling offshore.

Samples of drill cuttings which are separated from circulation fluid as described above are examined by geologists to evaluate the penetrated rock formations. Such examination is particularly important in connection with exploratory wells which are drilled for the purpose of determining the nature of the formation. It is important to collect samples from all penetrated depths so that the nature of the formations from the surface of the well to the bottom of the bore may be accurately determined. The importance of such samples are increased when, after drilling is complete, a wireline log cannot be acquired or is of poor quality because of a damaged bore. In such cases, the cutting samples and related hydrocarbon records are the only results to show for the expense of drilling the well.

In the past, drill cuttings samples were collected by placing a container in the flow of drill cuttings which falls from the shale shaker. The container is periodically emptied and collected samples are examined. Such prior art sample collectors suffer from several disadvantages. First, the container in which the samples are accumulated may fill to the top and overflow. Drill cuttings falling from the shale shaker when the container is full are not sampled and the record for such drill cuttings is lost. This is especially true in the case of a drilling operation which is drilling at a fairly rapid rate and is thus generating a high volume of drill cuttings per unit time.

Loss of drill cutting samples may also occur when fluids are accidentally introduced into the container collecting the samples. Such may occur as a result of a blinded shaker screen; i.e., the screen becomes clogged and permits circulation fluid to flow with the drill cuttings into the container. Samples may also be lost as a result of water from a hose, which is used to clean the shale shaker, entering the container. In addition, heavy rain and, in offshore drilling operations, waves may introduce water into the container, thus greatly reducing or destroying the information obtainable from the samples. There exists a need for a drill cuttings sample collector which can collect samples at different selected rates.

There also exists a need for a drill cuttings sample collector which prevents unwanted fluids from entering the collector.

SUMMARY OF THE INVENTION

The present invention comprises a novel apparatus for collecting a sample from a flow of falling drill cuttings. A receptacle includes an opening at the upper end thereof for receiving such a sample. Means for varying the area of the receptacle opening which is exposed to the drill cuttings flow is selectively extendable over the opening. The varying means comprises an element having a substantially planar surface which assumes an acute angle relative to the flow of drill cuttings when the apparatus is in operative condition. In another aspect of the invention, the covering comprises a pair of opposed sliding plates supported by a pair of opposed gabled ends.

The present invention is particularly useful for collecting a sample of drill cuttings from a flow of such cuttings falling from a shale shaker.

DETAILED DESCRIPTION OF THE PREFERRED EMBODIMENT

The present invention provides apparatus for collecting a sample from a flow of falling drill cuttings. A receptacle includes an opening at the upper end thereof for receiving such a sample. A housing supports the receptacle. Means are provided on the housing for covering a selected portion of the opening. In another aspect of the invention, the covering comprises of a pair of opposed sliding plates supported by a pair of opposed gabled ends.

Figure 1:
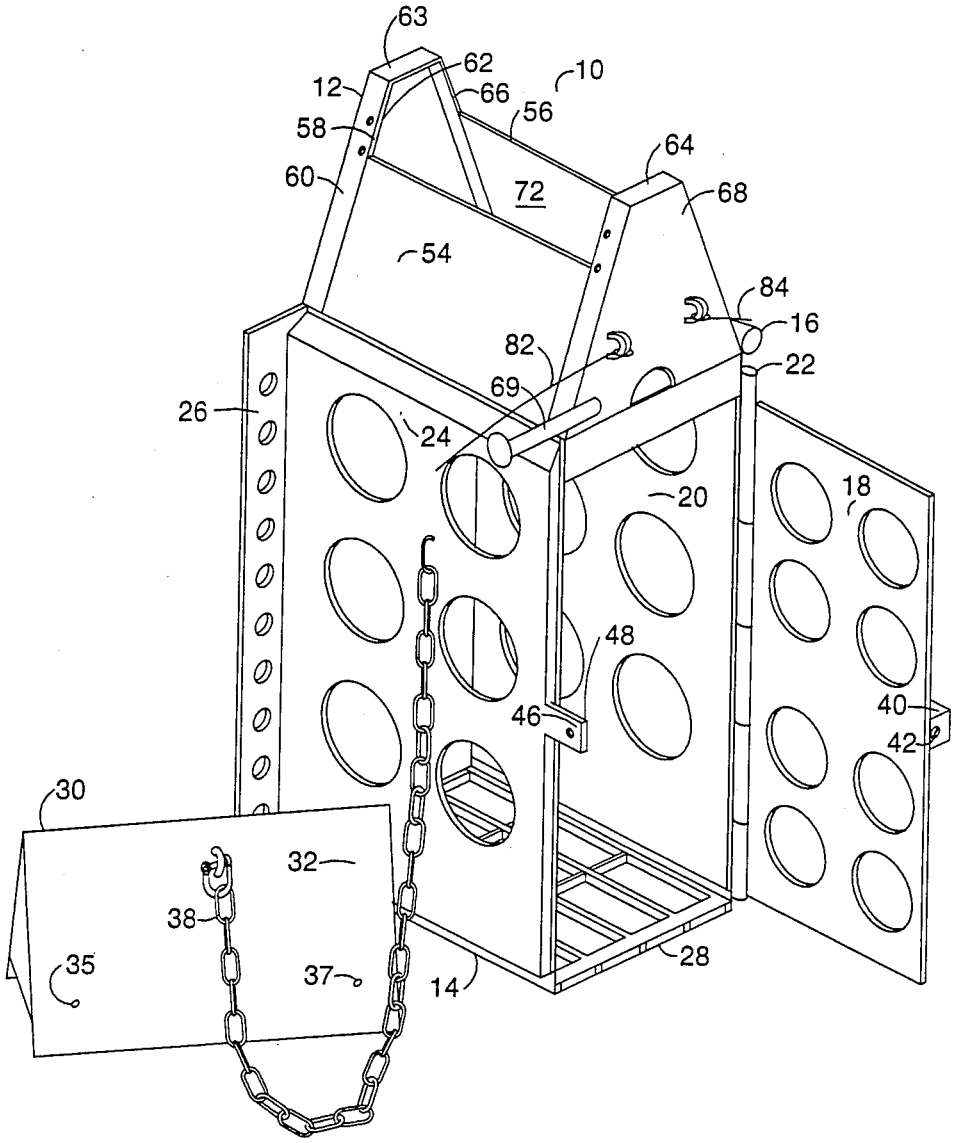
FIG. 1 is a perspective view of a portion of apparatus constructed in accordance with the instant invention.
Figure 2:
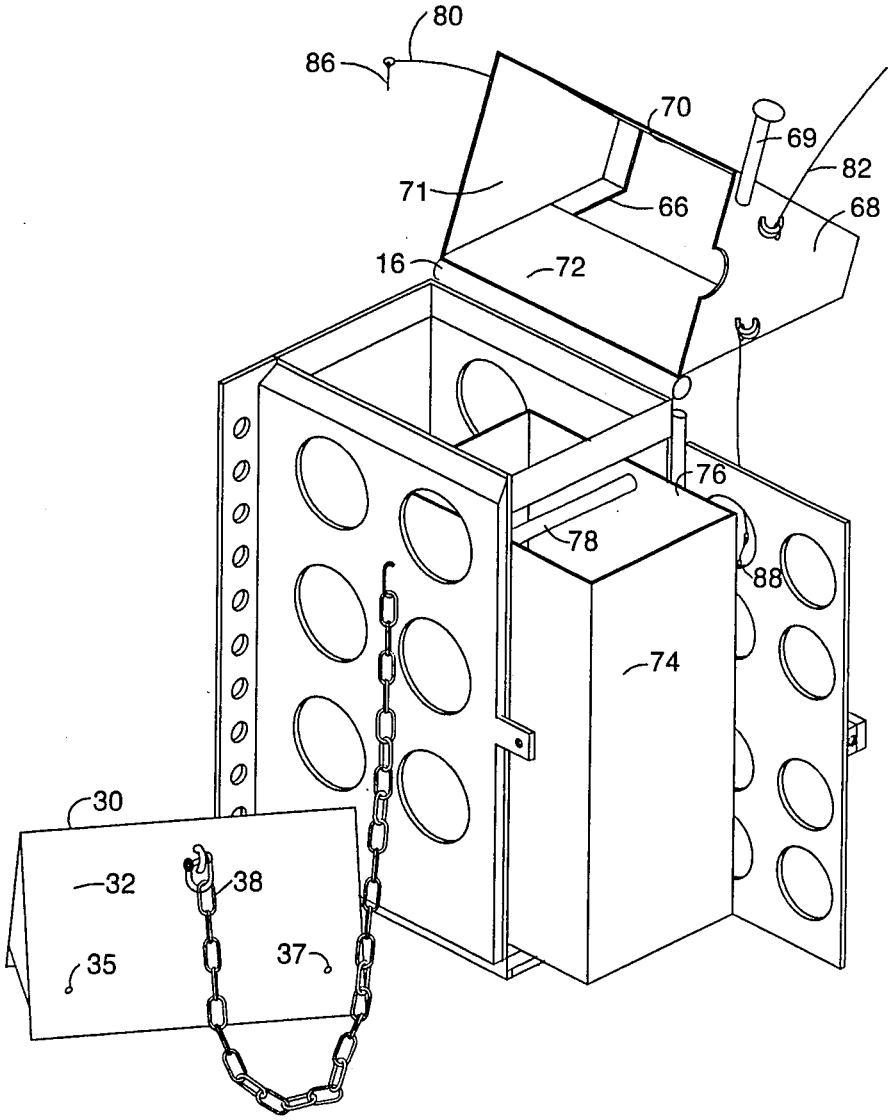
FIG. 2 is a view similar to FIG. 1 with the gabled top of the apparatus open and with an insert partially extending from the housing.
Figure 4:
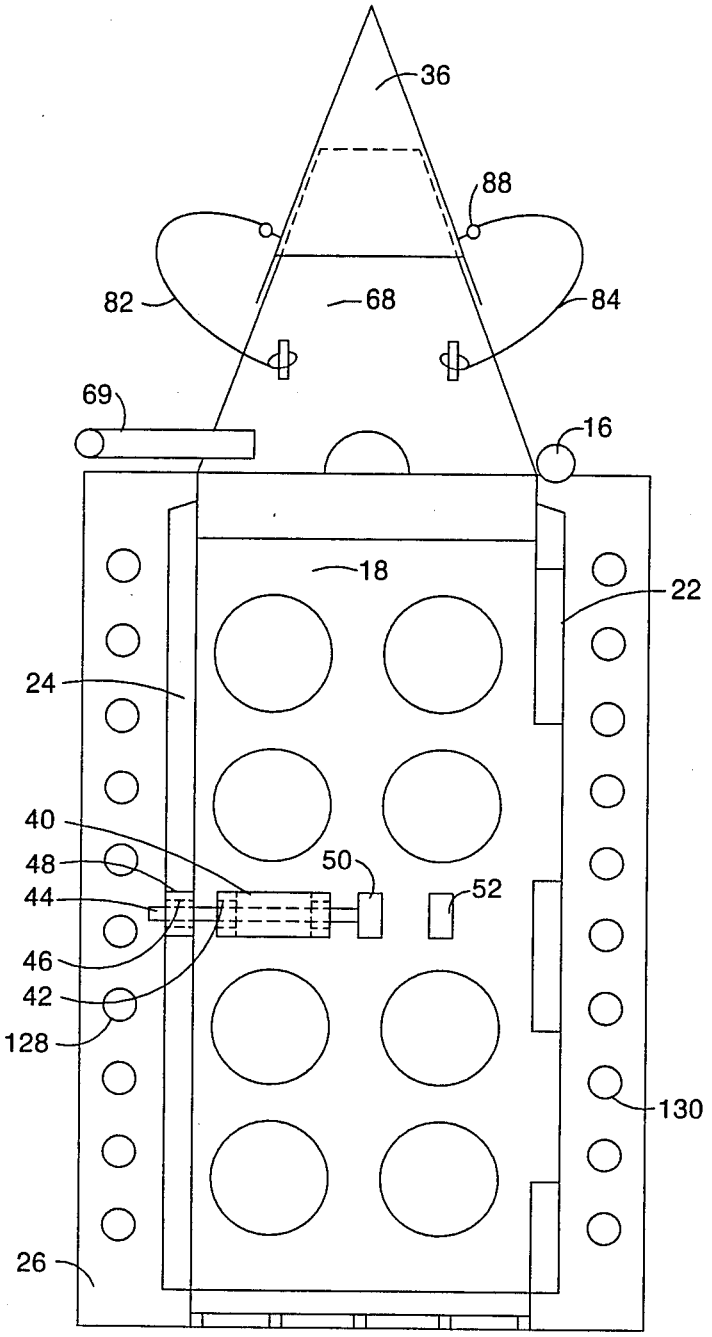
FIG. 4 is a front elevation view of the apparatus.

Referring now to the drawings and particularly to FIGS. 1, 2, and 4, indicated generally at 10 is a portion of a drill cuttings sample collector constructed in accordance with the instant invention. Included in collector 10 is a gabled top 12, such also being referred to herein as covering means or varying means. Top 12 is pivotally connected to a housing 14 by a hinge 16. Housing 14 includes a door 18 (shown in its open position in FIG. 1) which is pivotally connected to a side 20 of the housing by a hinge 22.

Housing 14 includes a pair of opposed parallel sides, one of which is side 20 and the other being side 24. A back or anchor plate 26 spans the rear of the housing at right angles between sides 20, 24. The portions of anchor plate 26 which extend outwardly from either side of the housing are best viewed in FIG. 4.

Door 18, sides 20, 24 and anchor plate 26 each include a plurality of holes therethrough as shown for reducing the overall weight of collector 10.

A bottom 28, such comprising a plurality of elongate bars forms the lower end of housing 14.

Figure 7:
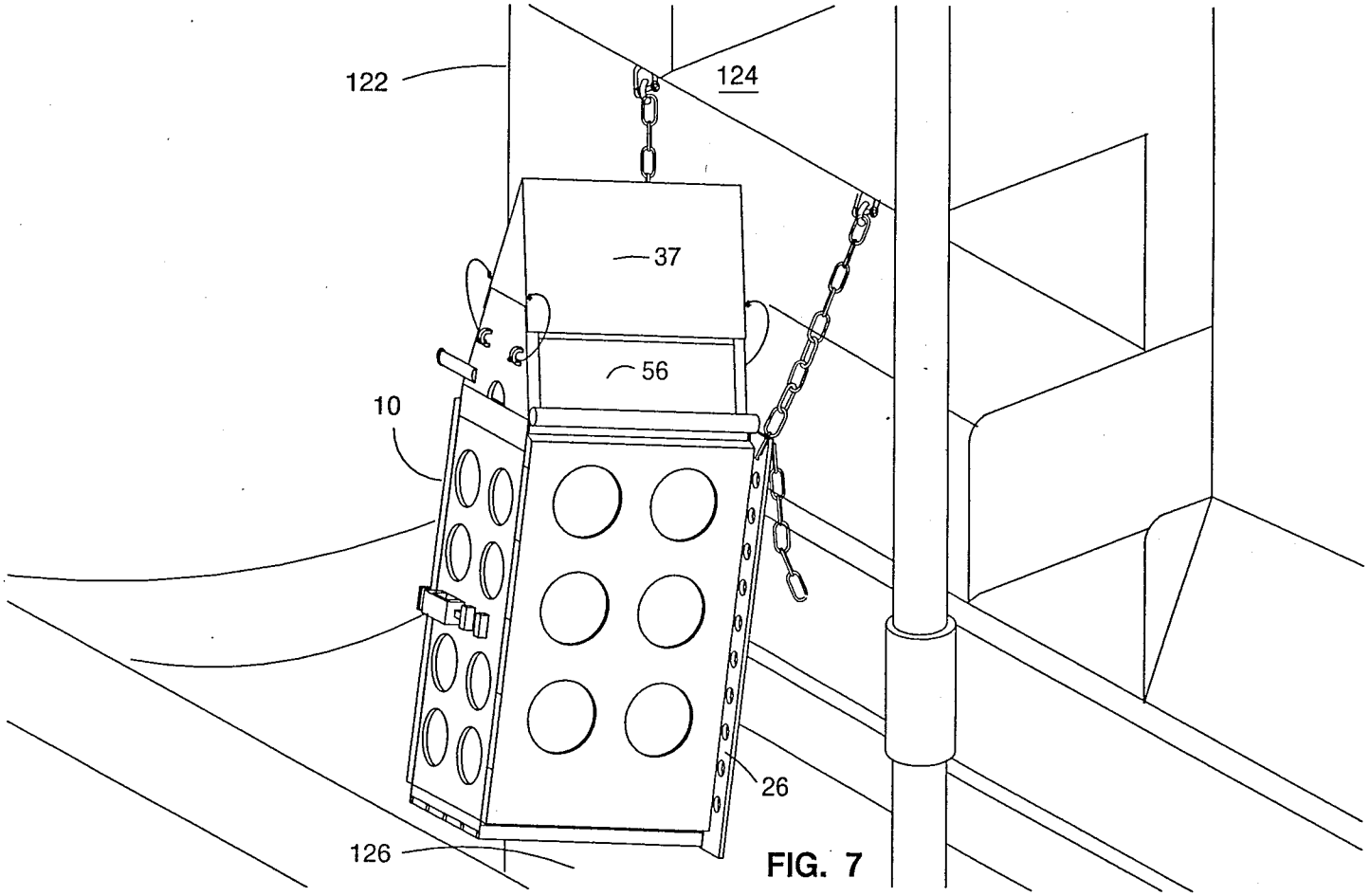
FIG. 7 is a perspective view of the apparatus installed adjacent a shale shaker.

A hood 30 includes a pair of opposing sides, one of which is side 32 and the other of which is side 34 (visible in FIG. 7) which are joined at their upper edges and which form an angle of about 40° with respect to one another. A pair of opposing triangular ends, one of which is end 36 in FIG. 4, are connected to the ends of each side 32, 34 to form a hood which can be placed on gabled top 12 as shown in FIGS. 4 and 7, which, as will be more fully described hereinafter, prevents entry of fluids and/or drill cuttings into housing 14. A pair of bores 35, 37 are formed in side 32. A similar pair of bores (not visible) are found in side 34. As will later be explained, these bores are used to mount hood 30 on gabled top 12.

A chain 38 connects hood 30 to side 24 of the housing.

A handle 40, also viewable in FIG. 4 is used to open and close door 18. A bore 42, one end of which is visible in FIG. 1, receives a bolt 44 which may be thrown into a bore 46 in a bolt receiver 48 which is mounted on side 24. When the bolt is so received, the door is locked. A slide block 50 is mounted on one end of bolt 44. Slide block travel is limited between handle 40 and a stop 52 which is fixedly mounted on door 18.

Returning again to FIG. 1, gabled top 12 includes therein a pair of opposed sliding plates 54, 56. Each end of plate 54 is received in a track, one of which is track 58. Track 58 is formed between a pair of parallel elongate plates 60, 62. Plate 54 is slideable between a lower position, shown in FIG. 1 and an upper position in which the upper edge of plate 54 is just beneath upper portions 63, 64 of gabled top 12. Each end of plate 56 is received in a similar track, one of which is track 66.

Gabled top 12 includes a pair of opposing substantially triangular-shaped ends, 68, 71. A handle 69 is mounted on end 68 and is used to move top 12 between the positions of FIGS. 1 and 2.

In FIG. 2, a pair of fixed plates 70, 72 are visible inside top 12. The lower edges of plates 70, 72 in combination with the lower edges of ends 68, 71 form the lowermost portion of gabled top 12 which, when the top is in the closed condition as shown in FIG. 1, rests on the top of housing 14.

Fixed plate 70 is substantially parallel to plate 54 and is substantially covered by plate 54 in the view of FIG. 1. Fixed plate 72 is substantially parallel to sliding plate 56 which, although not visible in FIG. 1, substantially covers plate 72 with plate 56 in the position of FIG. 1.

An insert 74, such also being referred to herein as a receptacle, includes an opening 76 at the upper thereof. Insert 74 is substantially rectangular in section and is of a size to fit inside housing 14 through door 18 as shown in FIG. 2. When insert 74 is fully received within the housing, door 18 may be shut and locked. A handle 78 spans opening 76 at the upper end of insert 74. With door 18 shut and locked, insert 74 may also be placed in or removed from housing 14 through the upper end thereof with gabled top 12 in the FIG. 2 position.

Four cables, three of which are cables 80, 82, 84 are attached at one end to gabled top 12 and include cotter pins, like cotter pins 86, 88, at their free ends. The cotter pins are used to fix the position of sliding plates 54, 56 as will be later explained.

Figure 3:
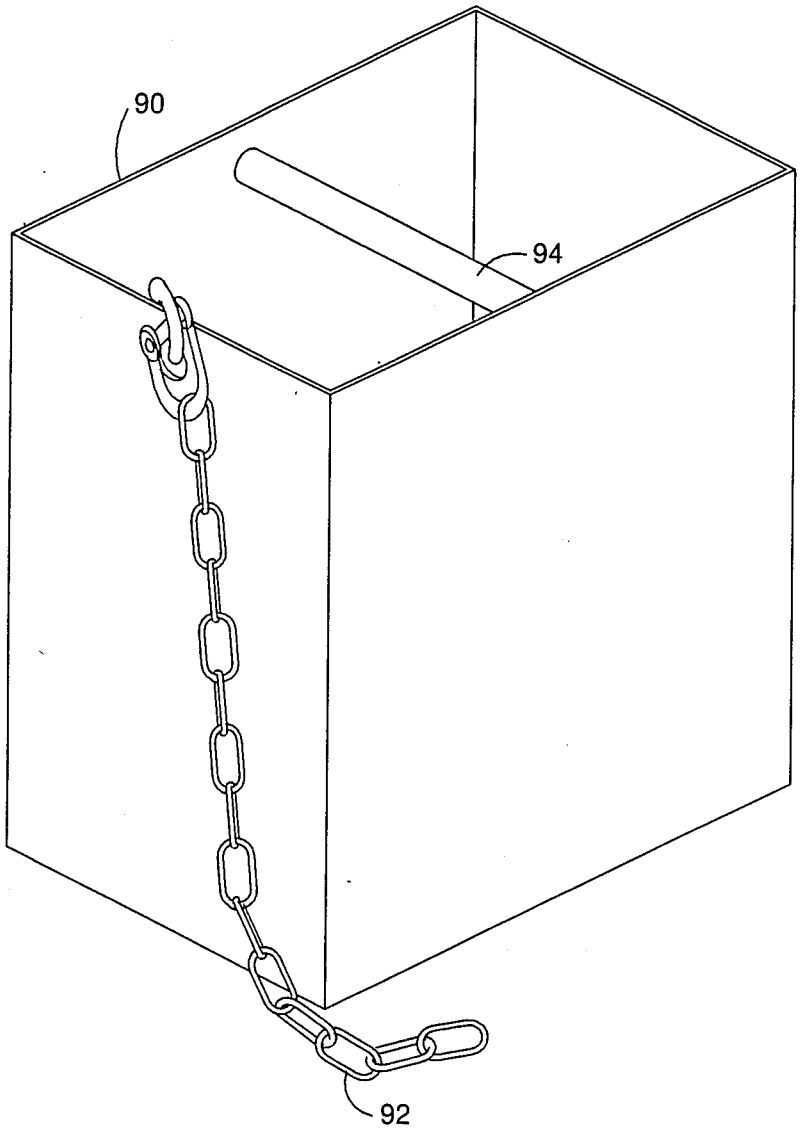
FIG. 3 is a perspective view of a smaller insert than that shown in FIG. 2.

Turning to FIG. 3, included therein is a second insert 90. Insert 90 is of the same width and depth as insert 74; however, it is approximately three-quarters of the height of insert 74 and includes a chain 92 connected to the upper front end thereof. Like insert 74, insert 90 includes a handle 94 across the upper portion thereof.

Figure 5:
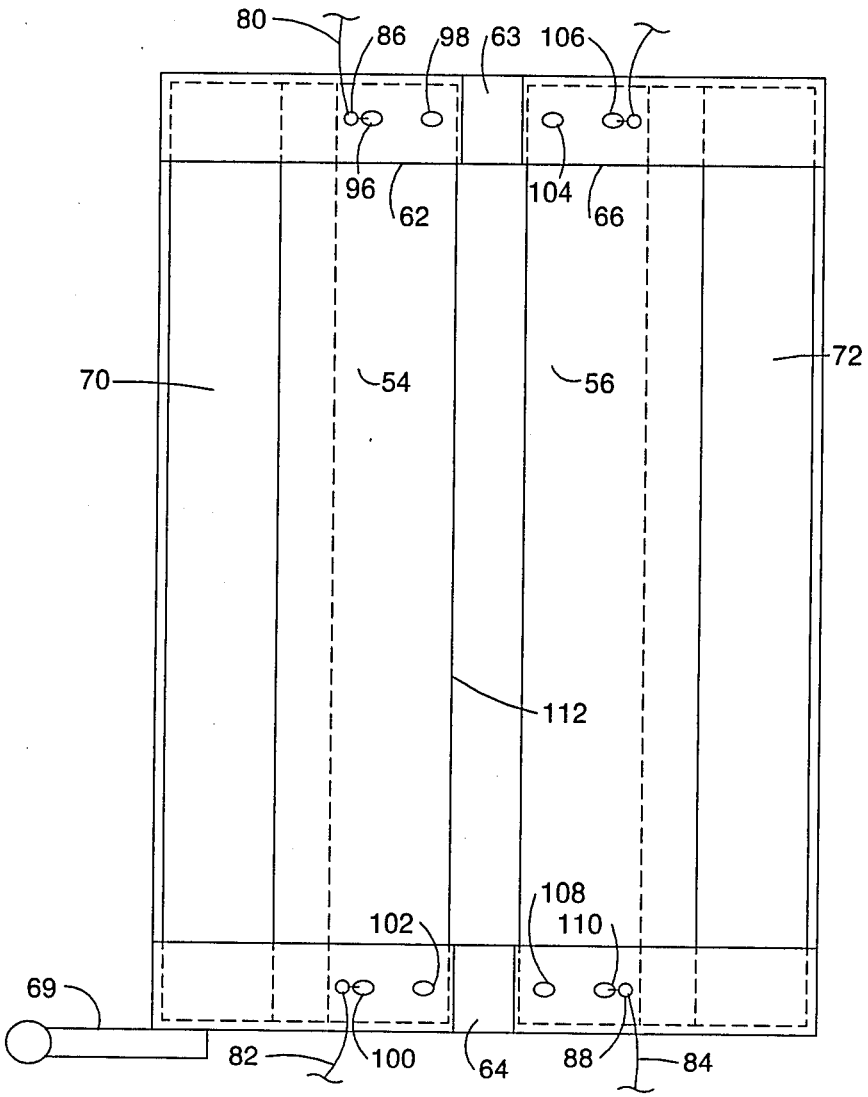
FIG. 5 is a top plan view of the apparatus.
Figure 6:
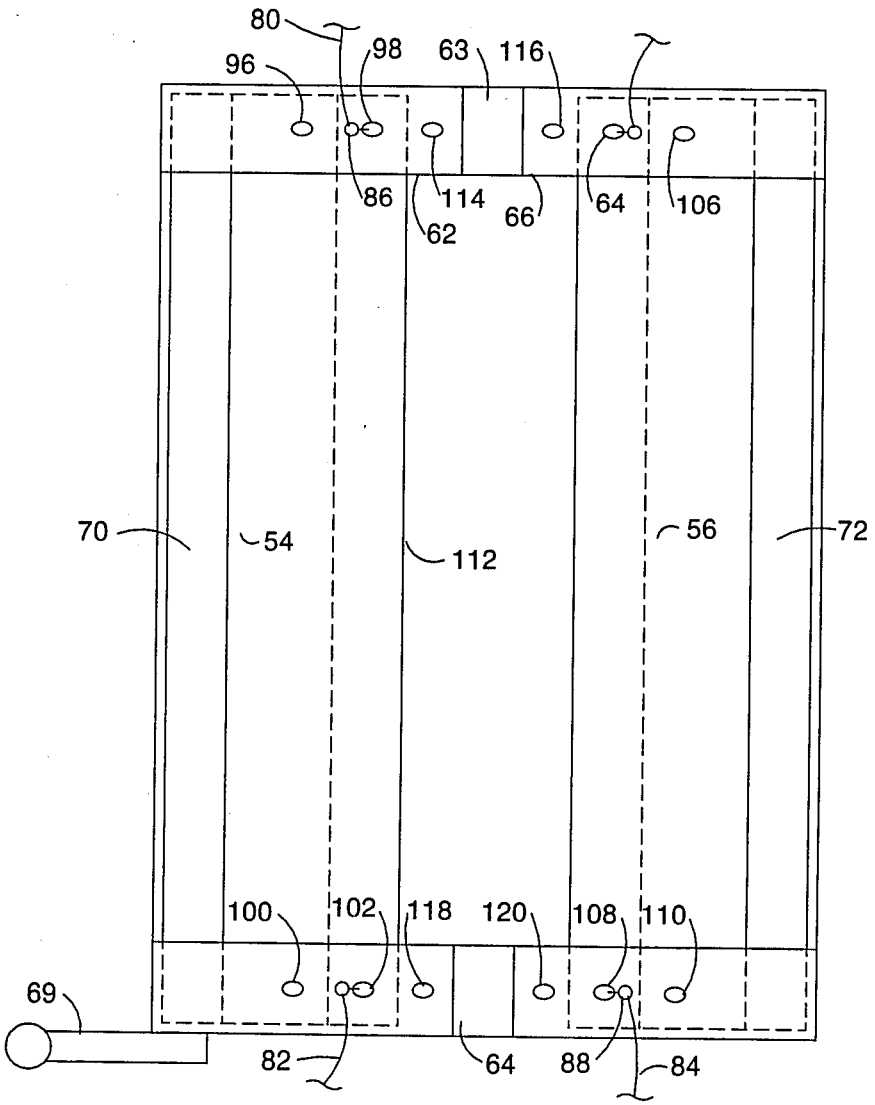
FIG. 6 is a view similar to FIG. 5 with the apparatus being adjusted to collect samples at a faster rate.

Turning attention now to FIGS. 5 and 6, in FIG. 5, plates 54, 56 are shown in their uppermost position while in FIG. 6 plates 54, 56 are shown in an intermediate position between the uppermost position of FIG. 5 and the lowermost position of FIG. 1. Sliding plate 54 includes four.bores 96, 98, 100, 102 therethrough. Similarly, plate 56 includes bores 104, 106, 108, 110. In the view of FIG. 5, each of the four cotter pins, like pins 86, 88, are received through one of the sliding plate bores, like pin 86 is received through bore 96. The pins are also received through coaxial bores formed through the track, like tracks 62, 66, adjacent to which the sliding plate bore is located. Such pinning fixes each of the sliding plates in the position shown and thus defines an opening 112 between the upper edges of sliding plates 54, 56.

In the view of FIG. 6, each of the cotter pins is received through the same bore in the track; however, each of the sliding plates have been moved downwardly from the position of FIG. 5 with pin 88 now being received through bore 108, pin 86 being received through bore 98, and each of the other two pins being received through the uppermost sliding plate bore thus expanding the size of opening 112 from that shown in FIG. 5.

With the plates in the configuration of FIG. 6, bores 114, 116, 118, 120 which are formed through the tracks, like bores 114, 116 are formed through tracks 62, 66, respectively, are visible. Bores 114–120 are in alignment with the bores on hood 30, like bores 35, 37, when the hood is mounted on gabled top 12 as shown in FIGS. 4 and 7. When the hood is so mounted, each of the four cotter pins may be inserted through the hood bores and into bores 114–120 to fix the hood on top 12.

Turning now to FIG. 7 and indicated generally at 122 is a commercially available shale shaker. Shale shaker 122 includes a vibrating screen 124 over which circulation fluid containing drill cuttings flows. Circulation fluid passes through the screen and is recirculated in the wellbore. The drill cuttings drop off screen 124 into a sump 126. Sample collector 10 is mounted via bores 128, 130 (in FIG. 4) on anchor plate 26 beneath screen 124.

In operation, when it is desired to use collector 10 to collect drill cutting samples, one of the inserts, insert 74 or insert 90, is placed inside housing 14 either through door 18 or through the top of the housing when gabled top 12 is opened as in FIG. 2. Once the insert is so positioned, sliding plates 52, 56 are set to one of their three positions, the position in FIG. 1, FIG. 5, or FIG. 6, depending upon the rate at which it is desired to accumulate drill cutting samples. When drilling is proceeding at a rapid rate and a relatively high volume of cuttings per unit of time is being generated, the position of FIG. 5 is desirable since fewer cuttings are allowed through opening 112 than in the position of FIG. 6 or in the position of FIG. 1. It is, of course, possible to collect cuttings with gabled top 12 hinged open as shown in FIG. 2, if drilling is proceeding at a very slow rate and few cuttings are being generated.

If a situation arises in which an undesired fluid may be accidentally passed through opening 112, hood 30 may be fitted over gabled top 12 as shown in FIG. 7.

With sliding plates 54, 56 in their lowermost position, each of the cotter pins, like pins 86, 88, may be passed through the bores, like bores 35, 37 in hood 30, and through bores 114–120 (in FIG. 6) in order to fix the hood to top 12. Alternatively, with the sliding plates set in either the intermediate position of FIG. 6 or the upper position of FIG. 5, the hood may be simply fitted over gabled top 12 without using the pins to secure the hood thereto in order to protect the collected samples from fluid contamination.

The angle of plates 54, 56, 70, 72, which make up substantially all of the upper surface of gabled top 12 is sufficient to prevent drill cuttings from accumulating in any quantity thereon. In the instant embodiment of the invention this surface is at an angle of about 20° relative to the vertical flow of drill cuttings. The same is true for sides 32, 34 of hood 30.

Normally, two sample collectors, like sample collector 10, will be mounted beneath the vibrating screens so that one may be collecting drill cutting samples while the other is having a full insert replaced by an empty insert for additional sample collection. During such insert changing, the sample collector continuously collects drill cutting samples as described above in order to preserve cutting samples collected at all formation levels.

It is to be appreciated that additions and modifications may be made to the embodiment disclosed herein without departing from the spirit of the invention which is defined in the following claims.

What is claimed is:

1. Apparatus for collecting a sample of drill cuttings from a flow of drill cuttings exiting a wellbore comprising:

a housing suspendable in a falling flow of drill cuttings, the housing including an opening at an upper end thereof;

a drill cuttings receptacle receivable within the housing and having an opening at an upper end thereof for receiving drill cuttings; and an inclined cover mounted to an upper portion of the housing and across the housing opening therein for varying the quantity of drill cuttings entering the receptacle, the cover including a pair of slideable plates moveable over said housing opening toward and away from a central region of said housing opening.

2. The apparatus of claim 1 wherein said cover includes tracks in which said plates are slideable relative to said tracks to selected positions therealong.

3. The apparatus of claim 2 wherein said cover includes a second pair of opposed plates, said second pair of plates being fixed adjacent opposite edges of said cover substantially equidistant from the central region of said opening, each of said second pair plates being substantially parallel to one of said slideable plates.

4. The apparatus of claim 1 wherein said cover is hingedly mounted on said housing for pivoting said cover to permit complete exposure of said housing opening to said drill cuttings flow when said apparatus is in operative condition.

5. The apparatus of claim 1 and including means for connecting the housing to a support on a drill rig to permit suspension of the apparatus within the falling flow of drill cuttings.

* * * * *